US006685001B2

(12) United States Patent
Krampl

(10) Patent No.: US 6,685,001 B2
(45) Date of Patent: Feb. 3, 2004

(54) ESCALATOR OR MOVING WALKWAY WITH OVERHEAD SUPPORT

(75) Inventor: David Krampl, Vienna (AT)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 10/167,107

(22) Filed: Jun. 11, 2002

(65) Prior Publication Data

US 2003/0000799 A1 Jan. 2, 2003

(30) Foreign Application Priority Data

Jun. 29, 2001 (EP) ..... 01810630

(51) Int. Cl.[7] ..... B65C 15/00; B65C 17/00; B66B 21/00; B66B 23/00; B66B 25/00

(52) U.S. Cl. ..... 198/321; 198/326

(58) Field of Search ..... 198/321, 326, 198/860.3, 860.4, 860.5

(56) References Cited

U.S. PATENT DOCUMENTS 4,790,527 A * 12/1988 Browning ..... 472/61
6,105,748 A 8/2000 Pallinger et al.
6,223,879 B1 * 5/2001 Schops ..... 198/321

FOREIGN PATENT DOCUMENTS

DE 709291 8/1941
WO WO 93/16232 8/1993

* cited by examiner

*Primary Examiner*—Gene O. Crawford
(74) *Attorney, Agent, or Firm*—Schweitzer Cornman Gross & Bondell LLP

(57) ABSTRACT

An escalator or moving walkway comprises at least one support structure which is supported between bearings. At least one upstanding support, which may be an arch or column, is provided. The support structure is connected at several points to the arch or the column, preferably by cables or rods. The columns or arches may be provided at each of the two sides of the moving walkway or the escalator and if the columns or arches and converge or run together above the escalator or moving walkway.

5 Claims, 2 Drawing Sheets

ESCALATOR OR MOVING WALKWAY WITH OVERHEAD SUPPORT

The present invention relates to an escalator or a moving walkway with at least one support structure which is supported between bearings.

BACKGROUND OF THE INVENTION

The support structure of a conventional escalator or a conventional moving walkway can bridge over only a relatively small span width. It is therefore long been known (see FIG. 3 of DE 709291 C1 (1941)) to additionally support the support structure by a column in the middle. If it is desired to build longer escalators or moving walkways, several columns for additional support are necessary.

With such a column support structure only very limited use can be made of the space below the moving walkway or below the escalator, because the columns are in the way.

It is the object of the present invention to provide an escalator or moving walkway of the foregoing kind with improved support means so that better utilisation can be made of the space in the region of the escalator or the moving walkway.

BRIEF DESCRIPTION OF THE INVENTION

According to the invention the object is met by a moving walkway or an escalator of the foregoing kind, wherein at least one arch or at least one column is provided for support and that a support structure is connected at several points to the arch or column, preferably by way of cables or rods.

In the case of use of a column the support structure can be supported in the manner of a cable-stayed bridge, for example at nine points, although with the exception of one location the entire region below the moving walkway or below the escalator remains clear. The same applies to an arch construction, wherein it is additionally advantageous that the arch has its foundation in the vicinity of the bearings, so that a very long continuous region remains clear.

It is advantageous if a respective column or arch is provided at each of the two sides of the moving walkway or escalator, and that the columns or arches converge or run together above the escalator. Lateral stability is increased in this manner and, in addition, an elegant, slender appearance results.

BRIEF DESCRIPTION OF THE DRAWINGS

Further features and advantages of the invention are evident from the following description of two illustrative embodiments with reference to the drawings, in which.

DETAILED DESCRIPTION OF THE INVENTION

The moving walkway is denoted generally by 1 (see FIGS. 1 to 4). It has at both sides a lateral support structure

11 which is constructed in usual manner in the form of a framework. The support structure 11 is additionally supported at its two ends in bearings 4.

Figure 2:
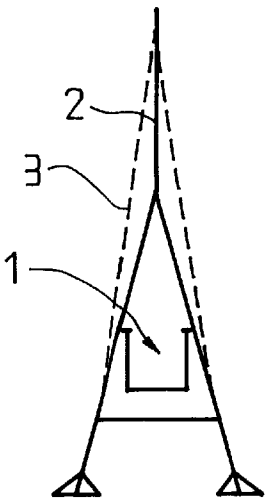
FIG. 2 is a view of the moving walkway of FIG. 1 from direction "II" in FIG. 1.
Figure 1:
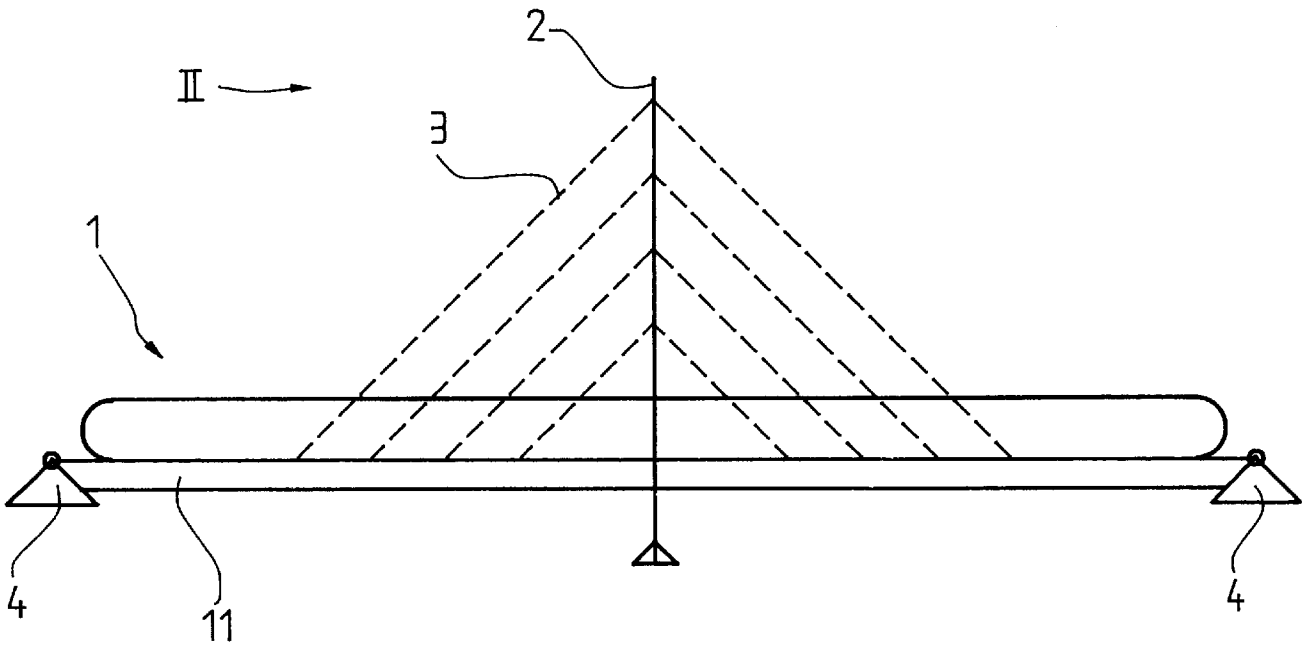
FIG. 1 is a side elevation view of a moving walkway with a column support according to the invention.

According to FIGS. 1 and 2 a column 2 is provided at each side of the moving walkway 1, forming a pylon construction. Cables 3 are fastened to the columns 2 at different heights, the cables extending obliquely relative to the support structure 11 and supporting it in the manner of a cable-stayed bridge. In the illustrated example four cables 3 are provided at each side of each column support structure 11 (thus in total 16 cables). The moving walkway 1 is thus additionally supported between the bearings 4 at, in total, nine points, but the entire space below the moving walkway 1 remains clear except for the columns 2. The two columns 2 have a relatively large spacing at the bottom (see FIG. 2) and join one another above the support structure 11 and moving walkway 1. Lateral stability is thereby also guaranteed. Self-evidently, an appropriately deep, concreted foundation is necessary. In addition, several pylons can obviously be provided in order to bridge over even greater distances.

Figure 4:
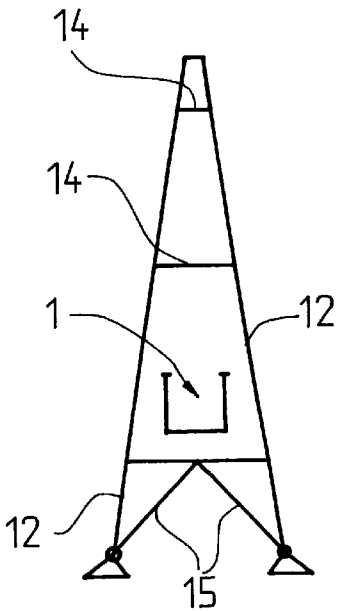
FIG. 4 is a view of the moving walkway of FIG. 3 from direction "IV" in FIG. 4.
Figure 3:
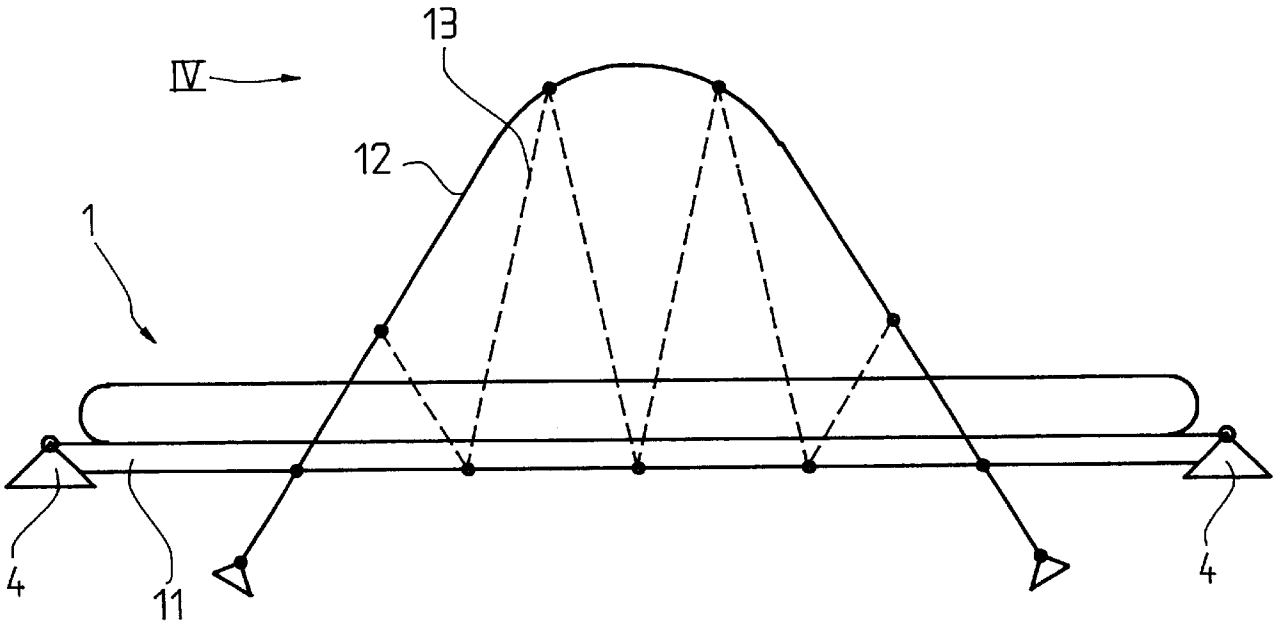
FIG. 3 is a side elevation view of a moving walkway with an arch support according to the invention.

According to FIGS. 3 and 4 an arch 12 may be provided at both sides of the moving walkway 1. These arches 12 have a greater spacing at the bottom than at the top and are connected together at several points by struts 14. Through these and through diagonal struts 15 the necessary lateral stability results.

Cables 13 run from the arches 12 to the support structure 11. In this example the support structure 11 is supported at, in total, five points between the bearings 4. However, almost the entire region below the moving walkway 1 remains clear, if the foundations for the arches 12, which lie in the vicinity of the bearings 4, are disregarded.

Moving walkways or escalators of the present type can find use in fairs, exhibitions, stations and so forth in order to bridge over large distances without a high number of center supports.

I claim:

1. An escalator or moving walkway, comprising a moving conveyor, at least one support structure extending along a side of the conveyor support bearings for the support structure at first and second ends of the support structure, at least one upwardly extending support located between the support structure ends, and a plurality of connectors extending between locations above the support structure on the upwardly extending supports and the support structure.

2. The escalator or moving walkway of claim 1 wherein the upward extending supports are also directly connected to the support structure.

3. The escalator or moving walkway of claim 1 wherein the connectors are chosen from the group consisting of cables and rods.

4. The escalator or moving walkway of claim 1 or claim 2 wherein the upwardly extending supports are chosen from the group consisting of columns and arches.

5. The escalator or moving walkway according to claim 4 wherein an upwardly extending support is located at each of two lateral sides of the moving walkway or escalator and converge or run together above the support structure.

* * * * *